United States Patent [19]

Friedrich

[11] Patent Number: 4,489,980

[45] Date of Patent: Dec. 25, 1984

[54] ADJUSTABLE ARM REST TRIGGER HANDLE

[75] Inventor: Paul H. Friedrich, Camarillo, Calif.

[73] Assignee: Everest & Jennings, Inc., Camarillo, Calif.

[21] Appl. No.: 462,341

[22] Filed: Jan. 31, 1983

[51] Int. Cl.[3] ..... A47C 7/54

[52] U.S. Cl. ..... 297/411; 297/416; 297/417

[58] Field of Search ..... 297/411, 412, 416, 417, 297/DIG. 4

[56] References Cited

U.S. PATENT DOCUMENTS

| | | | |
|---|---|---|---|
| 3,198,575 | 8/1965 | Hawkins | 297/416 X |
| 3,853,372 | 12/1974 | Meyer | 297/417 |
| 3,993,351 | 11/1976 | Rodaway | 297/416 |
| 4,358,125 | 11/1982 | Charles | 297/DIG. 4 |

FOREIGN PATENT DOCUMENTS

| | | | |
|---|---|---|---|
| 3003219 | 8/1981 | Fed. Rep. of Germany | 297/411 |

*Primary Examiner*—Francis K. Zugel

*Attorney, Agent, or Firm*—Ralph B. Pastoriza

[57] ABSTRACT

Front and rear downwardly extending arm rest support tubes are received in correspondingly positioned front and rear vertical receiving tubes on the side of a wheelchair. An integral S-shaped rod has an upper horizontal extending portion arranged to project into registered openings in the front telescoping tubes so that an arm rest on the arm rest support tubes can be positioned at a selected height and locked in such adjusted position. The S-shaped rod also functions as a handle to be engaged by the web of a patient's hand between the thumb and forefinger. Urging of the S shaped rod forwardly unlocks the tubes permitting vertical adjustment. A spring biases the S shaped rod rearwardly to effect automatic locking of the tubes in the adjusted position when the handle portion of the rod is released.

3 Claims, 3 Drawing Figures

ADJUSTABLE ARM REST TRIGGER HANDLE

FIELD OF THE INVENTION

This invention relates generally to wheelchairs and more particularly to an improved vertically adjustable wheelchair arm rest and operating mechanism therefor.

BACKGROUND OF THE INVENTION

Various arrangements have been proposed and many are in present use today for varying the vertical height of the padded arm rest normally provided on either side of a wheelchair seat. A major problem with all such systems as have been proposed is the difficulty of the wheelchair patient himself or herself to effect the desired vertical adjustment. For example, where telescoping tubes are employed, a small button detent type structure is often utilized to lock the telescoping tubes in selected positions. No difficulty is normally encountered with properly positioning the arm rest at a selected position by a nurse or other attendant. On the other hand, it is often very difficult if not impossible for a wheelchair patient, particularly when use of his or her arms and hands is impaired, to negotiate the necessary action to release the telescoping tubes and thereby permit adjustment of the arm rests.

In U.S. Pat. No. 3,993,351 owned by the same assignee as the present invention, there is disclosed a vertically adjustable wheelchair arm rest wherein an oval shaped collar surrounds the front telescoping tubes and carries a pin projecting into registering openings to lock the tubes in a desired position. This collar presents a fairly large area front surface for engagement by a portion of a patient's body, the patient urging the collar rearwardly to thereby release the pin and permit adjustment of the arm rest.

While the foregoing structure to some extent solves problems associated with adjustable arm rests as described heretofore, for certain types of immobile patients, it is very difficult to move the collar in a rearward direction with the hand or arm of the patient on the same side as the arm rest to be adjusted. While the collar can easily be urged rearwardly by the patient's opposite hand or arm or even wrist stub, it is very difficult for the patient to thereafter move the arm rest with the adjacent arm or hand to a desired vertical position.

BRIEF DESCRIPTION OF THE PRESENT INVENTION

With the foregoing considerations in mind, the present invention contemplates a specially designed handle and pin arrangement for locking and releasing vertically adjustable arm rests for wheelchairs which overcomes some of the immediately and previously noted problems.

Briefly, in accord with the present invention, front and rear vertical receiving tubes are provided on the side of a wheelchair. Front and rear arm rest support tubes, in turn, are telescopically received in the vertical receiving tubes respectively, the front arm rest support tube having a series of vertically spaced holes in its front wall and the front vertical receiving tube having a single hole in its front wall positioned to be in successive registration with the series of vertically spaced holes as the arm rest support tubes are raised and lowered to adjust the height of the arm rest carried thereby.

A single integral S-shaped rod is positioned with its uper horizontal extending end in front of the single hole for movement through the single hole into a registering hole to lock the telescoping tubes in a given position. Appropriate biasing and guide means are provided for the S-shaped rod to guide the horizontal movement of the rod, the S-shape itself defining a trigger handle for operation by a patient in the wheelchair.

In other words, the design is such that the hand of a patient adjacent to the side arm rest to be adjusted can easily be used to release the arm rest, the same then being adjusted by the patient's other hand.

BRIEF DESCRIPTION OF THE DRAWINGS

A better understanding of this invention will be had by referring to a preferred embodiment as illustrated in the accompanying drawings in which.

DETAILED DESCRIPTION OF THE PREFERRED EMBODIMENT

Figure 1:
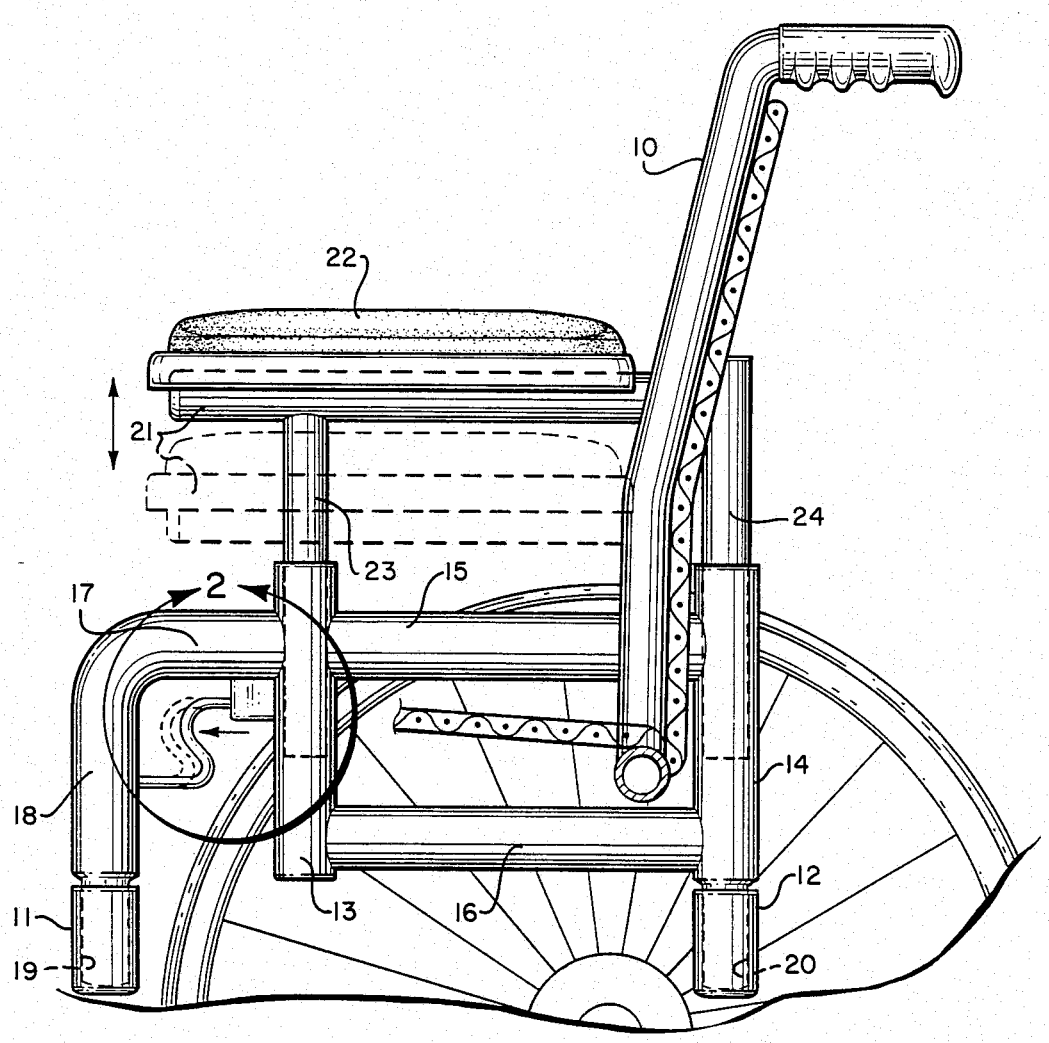
FIG. 1 is a fragmentary side elevational view partly in cross section of the right side of a wheelchair showing the adjustable arm rest assembly of this invention.

Referring to the upper right portion of FIG. 1 there is shown a wheelchair 10. Part of the frame for wheelchair 10 includes a front receiving socket 11 shown in the lower left portion of FIG. 1 and a rear receiving socket 12 for detachably supporting an arm rest assembly to the side of the chair.

As mentioned briefly heretofore, FIG. 1 shows the right side arm assembly for a wheelchair which includes a front vertical receiving tube 13, a rear vertical receiving tube 14, an upper horizontal tube 15 and a lower horizontal tube 16. Tubes 15 and 16 have their ends secured adjacent to the upper and lower ends of the vertical receiving tubes 13 and 14 as shown to define a rectangular frame assembly.

A front post tube has a horizontal portion 17 secured to and extending from the front vertical tube 13 in axial alignment with the upper horizontal tube 15. This front post also includes a vertical portion 18 extending downwardly to terminate in an end 19 receivable in the rear receiving socket 11 of the wheelchair. The lower end 20 of the rear vertical receiving tube 14, in turn, is receivable in the rear receiving socket 12 as shown so that the rectangular frame assembly is properly secured to the side of the wheelchair and yet can be removed by lifting the entire frame structure from the front and rear sockets 11 and 12.

As shown in the upper central portion of FIG. 1, the arm rest assembly includes an arm rest comprised of a horizontal tube 21 supporting an arm rest pad 22. A front arm rest support tube 23 and a rear arm rest support tube 24 extend downwardly from the arm rest, these tubes respectively being telescopically receiving in the front and rear vertical receiving tubes 13 and 14. It will be noted that by telescoping the front and rear arm rest support tubes 23 and 24 within the front and rear vertical receiving tubes 13 and 14, the vertical height of the arm rest relative to the wheelchair seat can be adjusted, all as indicated by the lowered phantom line position of the arm rest and the double headed arrow.

In order to lock the arm rest in a desired vertically adjusted position, there is provided a spring biased single integral S-shaped rod enclosed within the circular arrow 2 of FIG. 1. This structure can best be described by referring now to the enlarged cross section of FIG. 2.

As shown, the front arm rest support tube 23 includes a series of vertically spaced indexing holes 25 in its front wall. The front vertical receiving tube 13, in turn, includes under the horizontal portion 17 of the front post tube a single hole 26 in its forwardly facing wall positioned to be in successive registration with the series of indexing holes 25 when the front arm rest support tube 23 is telescoped within the front vertical receiving tube 13 to vary the height of the arm rest.

A support bracket 27 is secured to the underside of the horizontal portion 17 of the front post as at 28 and is provided with a guide opening 29 in coaxial alignment with the single hole 26. The S-shaped rod is shown at 30 in FIG. 2 with its referred to upper horizontally extending portion 31 passing through the guide hole 29 and into the single hole 26 and an indexing hole 25 when in a first position as shown. The rearwardly facing vertical portion of the front post shown at 18 in FIG. 2 has a guide opening 32 in a lower position to receive and guide the lower horizontally extending portion of the S-shaped rod shown at 33 when in this first position to stabilize the S-shaped rod. Essentially the S-shaped rod functions as a trigger handle, movement thereof in a forward direction, that is, to the left as viewed in FIG. 2, to a second position illustrated in phantom lines, freeing the upper horizontally extending portion 31 from the indexing hole 25. As a consequence, the front downwardly extending arm rest support tube 23 is free for telescoping movement. The lower horizontally extending portion 33 of the S-shape, in turn, simply moves further into the guide opening 32 than the trigger handle reaches in second positions so that stability of the trigger handle is maintained.

Figure 2:
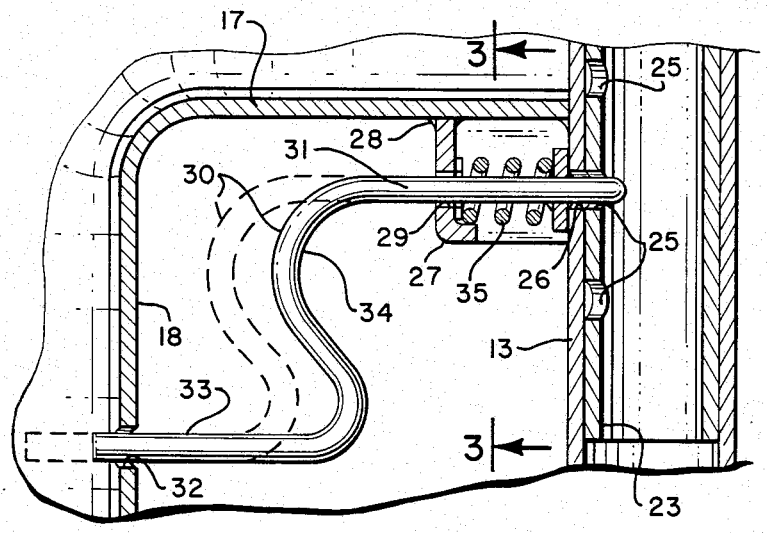
FIG. 2 is an enlarged fragmentary cross section of that portion of the apparatus of FIG. 1 enclosed within the circular arrow 2; and, FIG. 3 is a fragmentary cross section taken in the direction of the arrows 3—3 of FIG. 2.

The smoothly curved upper concave portion of the S-shape facing rearwardly is indicated at 34 in FIG. 2. This smoothly curved concave portion is conveniently engageable by the web of the hand between the thumb and forefinger for movement from the referred to first to the second position.

The foregoing trigger handle arrangement is completed by the provision of a biasing spring 35 disposed between the bracket 27 and the periphery of the single hole 26. This spring biases the S-shaped rod 30 to its first position so that upon release of the trigger handle, the same will automatically be returned to its first position when one of the indexing holes 25 comes into registration with the single hole 26.

Figure 3:
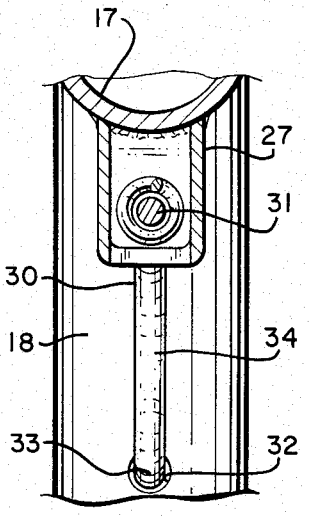

FIG. 3 shows in a front view looking in the direction of the arrows 3—3 of FIG. 2, the smoothly curved concave rearwardly facing portion 34 for the S-shaped rod. It will be evident that the lower guide opening 32 for the lower horizontally extending portion 33 of the S-shaped rod prevents rotation of the S-shaped rod about its upper horizontally extending portion 31 within the guide hole 29 and single hole 26. The rod is thus stabilized and its motion between its first and second positions illustrated by the solid and phantom line showings of FIG. 2 is appropriately guided with a minimum of friction.

It will be evident from the foregoing description that when it is desired to adjust the vertical level of the arm rest 21 shown in FIG. 1, a patient need only urge the S-shaped rod 30 forwardly with his hand closest to the arm rest assembly involved. Since the right hand arm rest assembly is depicted in FIG. 1, the patient will engage the rod 30 with the web portion of his right hand between the thumb and forefinger and simply urge the S-shaped rod forwardly to the phantom line position shown in FIG. 2. With his other hand, the patient can then adjust the arm rest 21 to the desired height and then release the S-shaped rod 30 thereby permitting the spring 35 to return the S-shaped rod to its first position which locks the arm rest in the adjusted position.

The arm rest on the left side of the wheelchair is similarly constructed so that the patient can use his web portion between the thumb and forefinger of his left hand to urge the S-shaped rod forwardly and thereby easily release the locked telescoping tubes and enable adjustment of the left side arm rest by using his right hand.

It will be evident from the foregoing, that because of the fairly large S-shaped rod construction, even though a patient may have little dexterity with his hand, he or she can still urge forwardly the S-shaped rod to unlock the telescoped tubes and permit adjustment of the arm rest.

I claim:

1. A wheelchair adjustable arm rest assembly including:

(a) front and rear vertical receiving tubes on a side of the wheelchair;

(b) an arm rest;

(c) front and rear arm rest support tubes telescopically receivable in said vertical receiving tubes respectively the front arm rest support tube having a seris of vertically spaced holes in its front wall and the front vertical receiving tube having a single hole in its front wall positioned to be in successive registration with said series of vertically spaced holes as the arm rest support tubes are raised and lowered to adjust the height of the arm rest;

(d) a single integral S shaped rod having the upper horizontal extending end of the S shape positioned in front of said single hole for movement through the single hole into a registering hole to lock the telescoping tubes in a given position; and (e) a front post having an horizontal portion extending from the front of the front vertical receiving tube above said single hole, thence turning downwardly into a vertical portion connecting to said wheelchair, the rear wall of said vertical portion of said front post having a guide hole facing rearwardly in a position to receive the lower horizontal extending end of the S shape to guide horizontal movement of the rod into and out of a registering hole and to provide stability for the rod when moved back and forth in an horizontal direction to lock and unlock the arm rest support tube, said S shape defining a trigger handle for operation by a patient in the wheelchair.

2. An assembly according to claim 1, including a spring biasing said S shaped rod into said single hole so that when said rod is released by a patient, said upper extending horizontal end is automatically biased into one of said series of holes when the same is in registration with said single hole.

3. An adjustable arm rest assembly for wheelchairs wherein the wheelchairs include a front receiving socket and a rear receiving socket to detachably support the assembly, said assembly including, in combination:

(a) a front vertical receiving tube and a rear vertical receiving tube;

(b) an upper horizontal tube and a lower horizontal tube secured at their ends adjacent to the upper and lower ends of the vertical receiving tubes to define a rectangular frame assembly;

(c) a front post tube having a horizontal portion secured to and extending from said front vertical tube in axial alignment with said upper horizontal tube, and a vertical portion extending downwardly to terminate in an end receivable in the front receiving socket of the wheelchair, the lower end of the rear vertical receiving tube being receivable in said rear receiving socket of the wheelchair so that the rectangular frame assembly is secured to a side of the wheelchair;

(d) an arm rest;

(e) a front arm rest support tube and a rear arm rest support tube for supporting said arm rest, respectively telescopically received in the front and rear vertical receiving tubes, said front arm rest support tube having a series of vertically spaced indexing holes, the forwardly facing wall of said front vertical receiving tube under the horizontal portion of said front post tube having a single hole positioned to be in successive registration with said series of indexing holes when said front arm rest support tube is telescoped within said front vertical receiving tube to vary the height of said arm rest;

(f) a support braket secured to the underside of said horizontal portion of said front post and having a guide opening in coaxial alignment with said single hole;

(g) a trigger handle in the form of an integral S shaped rod having the upper horizontally extending portion of the S shape passing through said guide hole and into said single hole and an indexing hole when in a first position, the rearwardly facing vertical portion of said front post having a guide opening in a lower position to receive and guide the lower horizontally extending portion of said S shaped rod when in first position to stabilize the trigger handle, movement of said trigger handle in a forward direction to a second position freeing said upper horizontally extending portion from said indexing hole to free said front downwardly extending arm rest support tube for telescoping movement, the lower horizontally extending portion of said S shape moving further into said guide opening in the vertical portion of the front post as the trigger handle reaches its second position so that stability of the trigger handle is maintained, the smoothly curved upper concave portion of said S shape facing rearwardly being conveniently engageable by the web of the hand between the thumb and forefinger for movement from said first to said second position; and (h) a spring disposed between said bracket and the periphery of said single hole biasing said S shaped rod to its first position so that upon release of the trigger handle, the same will automatically return to its first position when one of said indexing holes comes into registration with said single hole.

* * * * *